US008336159B2

(12) United States Patent
Chen et al.

(10) Patent No.: US 8,336,159 B2
(45) Date of Patent: Dec. 25, 2012

(54) NON-STEPPING WRINGER BUCKET

(75) Inventors: Yung-Hua Chen, Lujhou (TW); Chin-Yang Shin, Gueishan Township, Taoyuan County (TW)

(73) Assignee: Tuo Shen International Corporation Limited, Taoyuan County (TW)

( * ) Notice: Subject to any disclaimer, the term of this patent is extended or adjusted under 35 U.S.C. 154(b) by 516 days.

(21) Appl. No.: 12/588,509

(22) Filed: Oct. 19, 2009

(65) Prior Publication Data

US 2011/0088193 A1 Apr. 21, 2011

(51) Int. Cl.

| | |
|---|---|
| ***A47L 13/14*** | (2006.01) |
| ***A47L 13/58*** | (2006.01) |
| ***A47J 47/18*** | (2006.01) |
| ***A47L 13/50*** | (2006.01) |
| ***A47L 17/00*** | (2006.01) |
| ***D06F 29/00*** | (2006.01) |
| ***D06F 39/00*** | (2006.01) |
| ***D06F 51/00*** | (2006.01) |
| ***F26B 17/24*** | (2006.01) |
| ***F26B 17/30*** | (2006.01) |

(52) U.S. Cl. ..... 15/260; 15/264; 68/241; 34/58

(58) Field of Classification Search ..... 15/263, 15/264, 260, 119.1, 116.1; D32/53; 4/641, 4/696; 403/202, 203, 225; 34/58; 68/23.2, 68/23.3, 241, 213; 210/360.1, 403, 380.1, 210/380.2

See application file for complete search history.

(56) References Cited

U.S. PATENT DOCUMENTS

| | | | | |
|---|---|---|---|---|
| 217,675 | A * | 7/1879 | Boswell | 15/263 |
| 4,961,722 | A * | 10/1990 | Taylor et al. | 494/36 |
| 5,064,535 | A * | 11/1991 | Hsu | 210/380.1 |
| 5,184,544 | A * | 2/1993 | Ling | 99/536 |
| 5,190,269 | A * | 3/1993 | Ikeda et al. | 267/140.12 |
| 5,199,571 | A * | 4/1993 | Wolff et al. | 206/518 |
| 5,490,453 | A * | 2/1996 | Mackay | 99/495 |
| 7,258,615 | B2 * | 8/2007 | Sadakata et al. | 464/89 |
| 7,743,528 | B2 * | 6/2010 | Lin | 34/58 |
| 7,798,722 | B2 * | 9/2010 | Wulf et al. | 384/297 |
| D647,268 | S * | 10/2011 | Chen | D32/53 |
| 8,028,369 | B2 * | 10/2011 | Chiang | 15/260 |
| 8,056,179 | B2 * | 11/2011 | Hsu | 15/260 |
| 8,065,777 | B2 * | 11/2011 | Lin | 15/260 |
| 2009/0151399 | A1 * | 6/2009 | Lin | 68/23 R |
| 2011/0000046 | A1 * | 1/2011 | Chen et al. | 15/260 |
| 2011/0010885 | A1 * | 1/2011 | Tseng | 15/260 |
| 2011/0154607 | A1 * | 6/2011 | Chen | 15/260 |
| 2011/0173770 | A1 * | 7/2011 | Chen | 15/260 |
| 2011/0247169 | A1 * | 10/2011 | Chen | 15/260 |

* cited by examiner

*Primary Examiner* — Vanitha Elgart
(74) *Attorney, Agent, or Firm* — Rosenberg, Klein & Lee

(57) ABSTRACT

A non-stepping wringer bucket includes a bucket body, having a top surface substantially in a form of an opening, and a bottom surface having a protruding base; a support shaft fixed on the protruding base, the upper part of the support shaft protruding from the top of the protruding base, forming a combining-section having a ringed trough; an orientate element made from flexible material, tapering on the top, and with a central hole corresponding to the ringed trough the ringed trough receives the orientate element thereon; a dewatering basket and a rotating element installed at the bottom of a rotating base, the rotating base sheathed onto the support shaft and installed at the bottom of the dewatering basket.

9 Claims, 10 Drawing Sheets

NON-STEPPING WRINGER BUCKET

BACKGROUND OF THE INVENTION

1. Field of the Invention

The present invention relates to a wringer bucket, in particular to a non-stepping wringer bucket that provides a high-safety application without requiring any foot-stepping action.

2. Description of the Related Art

Mop is one of the cleaning tools used for cleaning a floor, and traditional wringer buckets are used for removing extra water from the mop, and the traditional wringer buckets generally squeeze fabrics of the mop to remove water on the mop fabrics. As disclosed in R.O.C. Pat. No. M338634, a wringer bucket includes a casing, an installing portion, and a rotating unit, wherein the rotating unit includes a retaining element, an axle, a transmission unit and a push rod unit, such that interactions between the aforementioned components drive the rotating unit to rotate to dewater the mop.

However, the aforementioned conventional wringer bucket requires many components in the rotating unit, and thus results in a complicated structure with too many components and shortens the using life of the wringer bucket.

Furthermore, the design of such wringer bucket not only has the disadvantages of a complicated structure and an uneasy installation, but also require users to stand with one foot and step a pail pedal of the wringer bucket by another foot, such that the users may loss balance, fall down or get hurt.

When such wringer buckets are shipped out from a factory, internal components of the wringer buckets are assembled completely, and thus the wringer buckets cannot be transported by a stacking method, and manufacturers have to transport the wringer buckets with a large volume. As the result, a higher transportation cost will be incurred, which is unfavorable to both manufacturers and consumers.

SUMMARY OF THE INVENTION

A primary object of the invention is to provide a non-stepping wringer bucket featuring a high-safety application without requiring any foot-stepping action.

Another object of the present invention is to provide a non-stepping wringer bucket with a simple structure and a low cost and to prevent the water from seeping through the non-stepping wringer bucket.

A further object of the present invention is to provide a non-stepping wringer bucket that can be stacked conveniently for storage and transportation, without occupying much space and thus saving the transportation cost.

In order to achieve the above-mentioned objects, a non-stepping wringer bucket in accordance with the invention includes:

a) a bucket body, having a top surface substantially in a form of an opening, and a bottom surface having a protruding base;

b) a support shaft, the under part of the support shaft covered and fixed on the protruding base, the upper part of the support shaft protruding from the top of the protruding base, forming a combining-section having a ringed trough;

c) an orientate element made from flexible material, wherein the orientate element in the form of an awl, tapering on the top, and with a mid hole matched up the ringed trough thus the ringed trough sheathed with the orientate element, forming the bottom of the protruding part of the orientate element into a positioned surface; and d) a dewatering basket, having a plurality of holes disposed at the periphery and bottom surface of the dewatering basket, and a rotating element installed at the bottom of a rotating base, the rotating base sheathed onto the support shaft and installed at the bottom of the dewatering basket, while assembling the dewatering basket extruded the rotating element through the combining-section thus the rotating base sheathed onto the support shaft and bases on the positioned surface which prevented the dewatering basket from shedding.

The non-stepping wringer bucket of the present invention does not come with an active driving device, but makes use of the rotation of a mop to dewater the mop.

The non-stepping wringer bucket of the present invention further comprises a handle for facilitating users to carry the wringer bucket, and the bucket body has an opening substantially in an ∞ shape, and a convex cambered surface protruded from the bottom of the bucket body for enhancing a support force of the bucket body, such that when the rotating element is rotated, the non-stepping wringer bucket will not be shaken.

DETAILED DESCRIPTION OF THE PREFERRED EMBODIMENT

Figure 1:
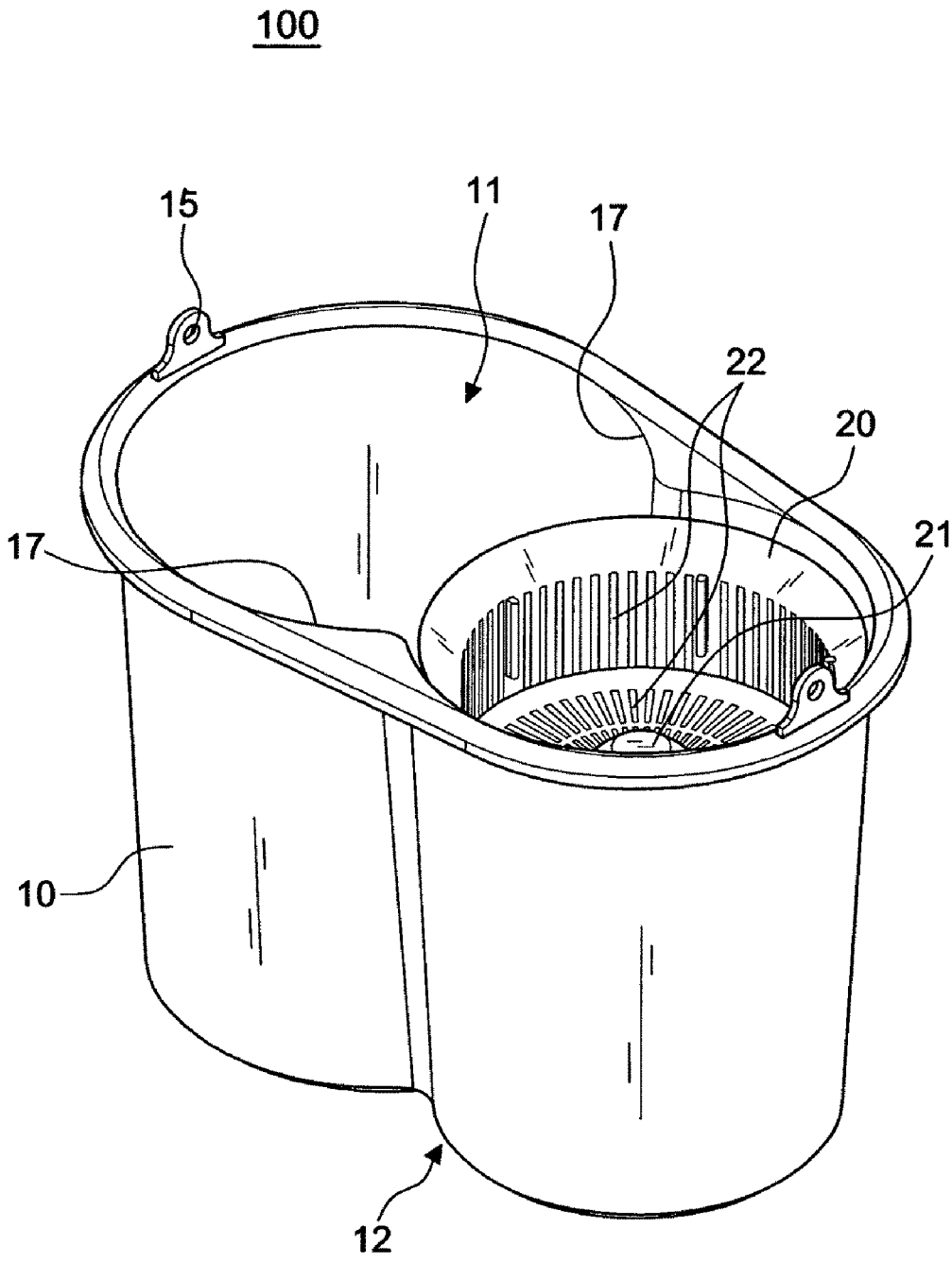
FIG. 1 is a perspective view of the present invention.
Figure 2:
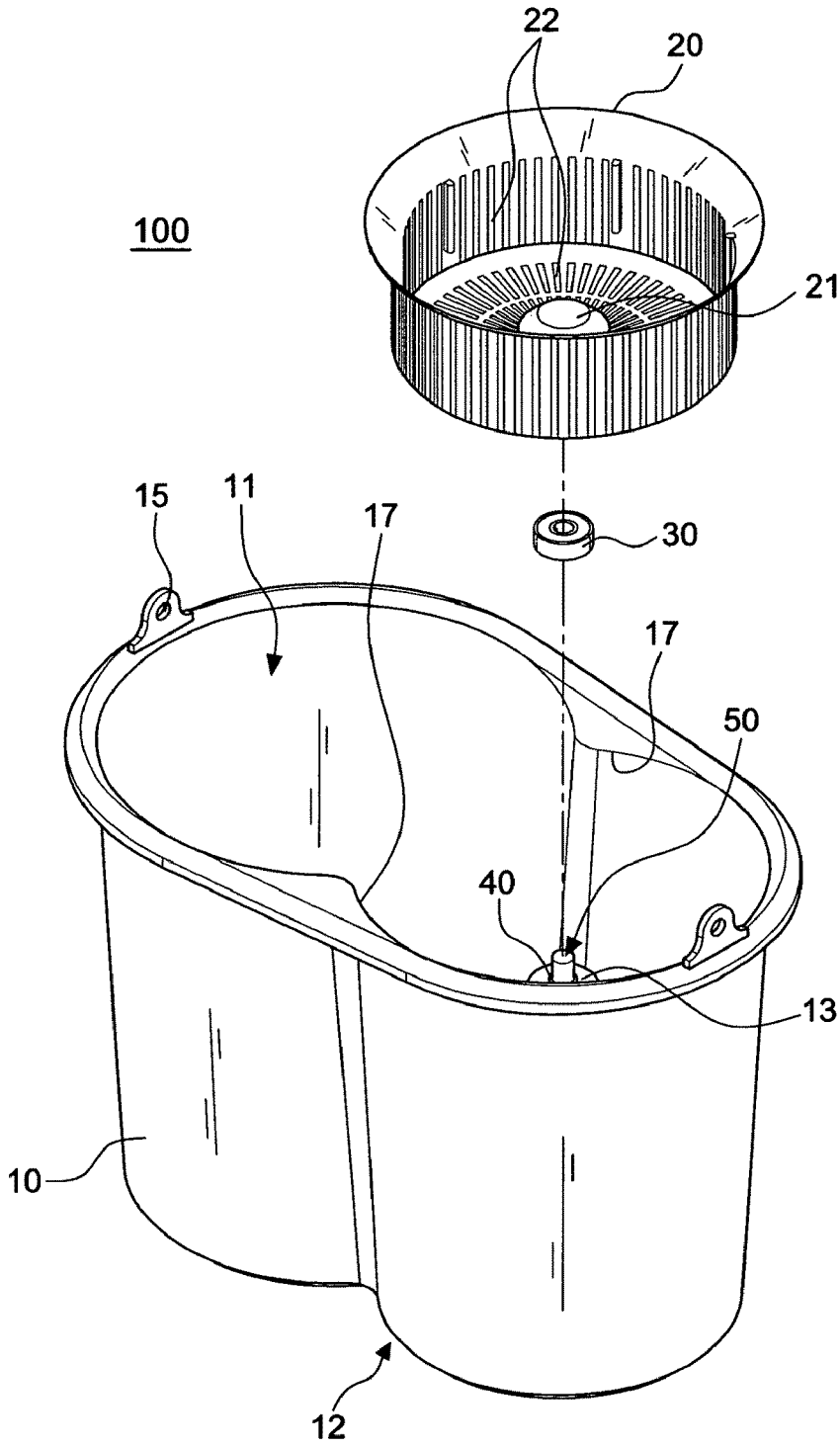
FIG. 2 is a perspective exploded view of the present invention.

With reference to FIGS. 1 to 6 for a non-stepping wringer bucket in accordance with the present invention, the non-stepping wringer bucket 100 comprises a bucket body 10, a dewatering basket 20, a rotating element 30, a support shaft 50 and an orientate element 40, wherein a top surface of the bucket body 10 is substantially an opening 11, and a protruding base 13 is protruded from a bottom surface 12 of the bucket body 10, and a vertical support shaft 50 is fixed onto the protruding base 13. The dewatering basket 20 includes a plurality of dewatering holes 22 disposed at the periphery and the bottom surface of the dewatering basket 20.

Figure 3:
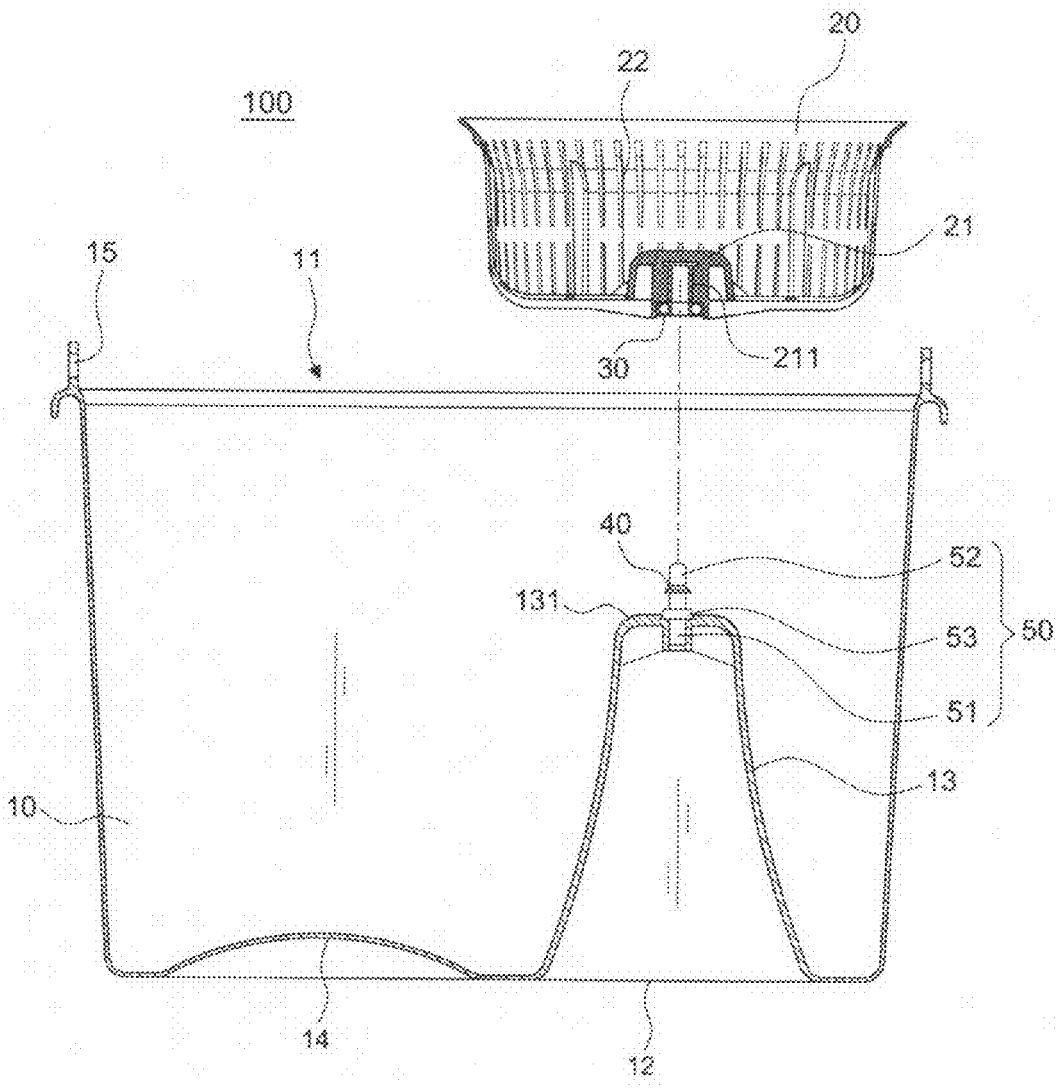
FIG. 3 is a cross-sectional view of a disassembled structure of the present invention.
Figure 4A:
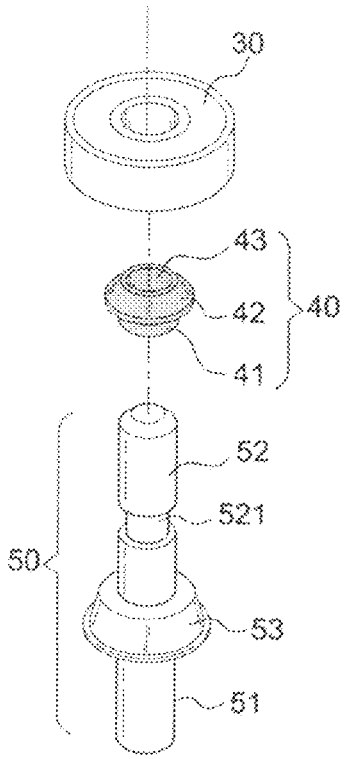
FIG. 4A~4C is a schematic view of the orient element assembling on the support shaft of the present invention.
Figure 4B:
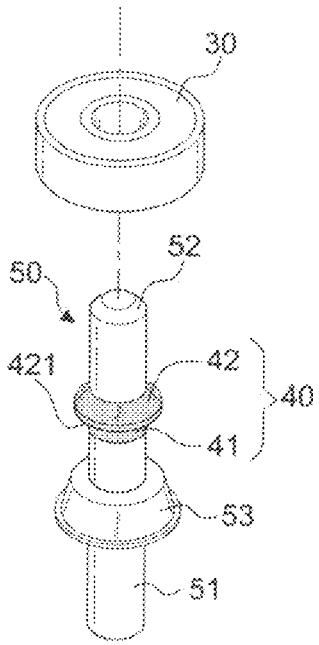
Figure 4C:
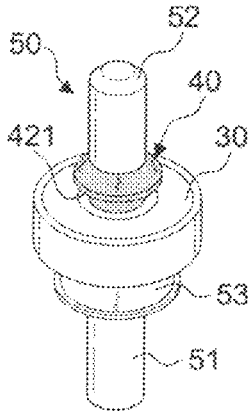
Figure 5:
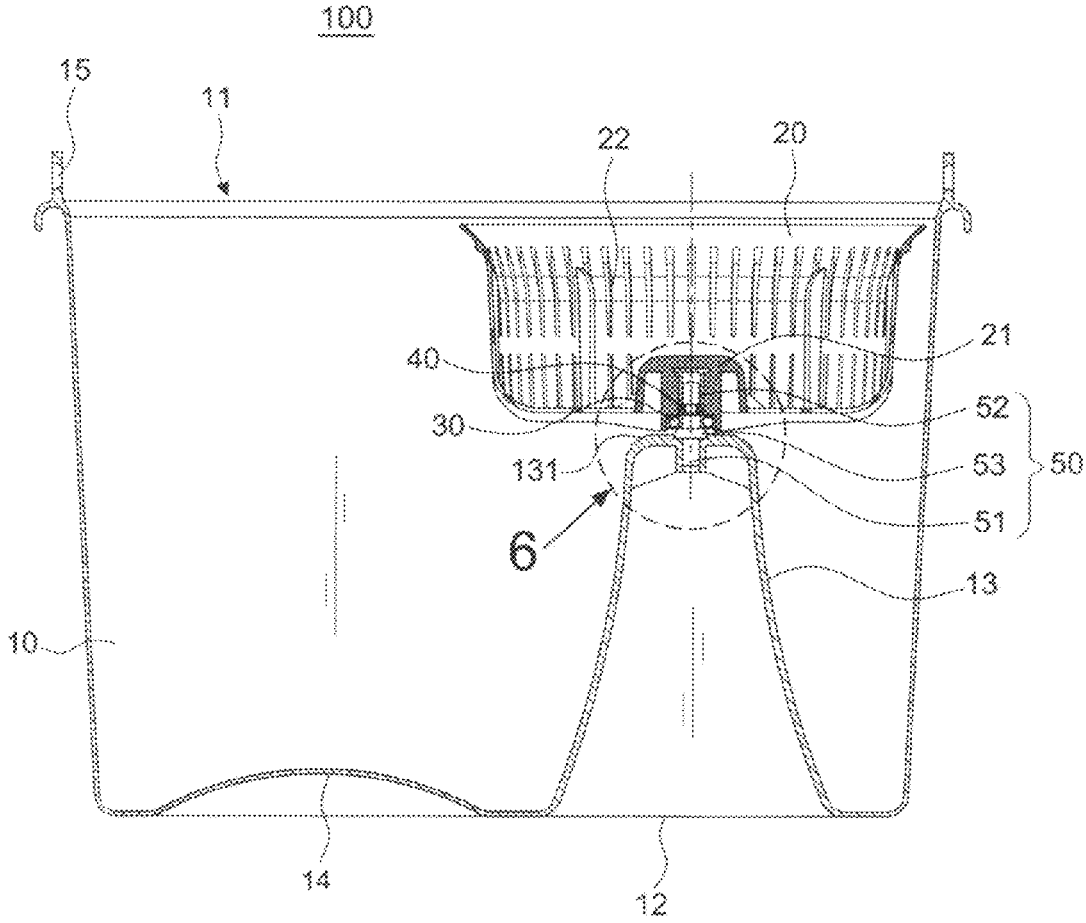
FIG. 5 is a cross-sectional view of an assembled structure of the present invention.
Figure 10:
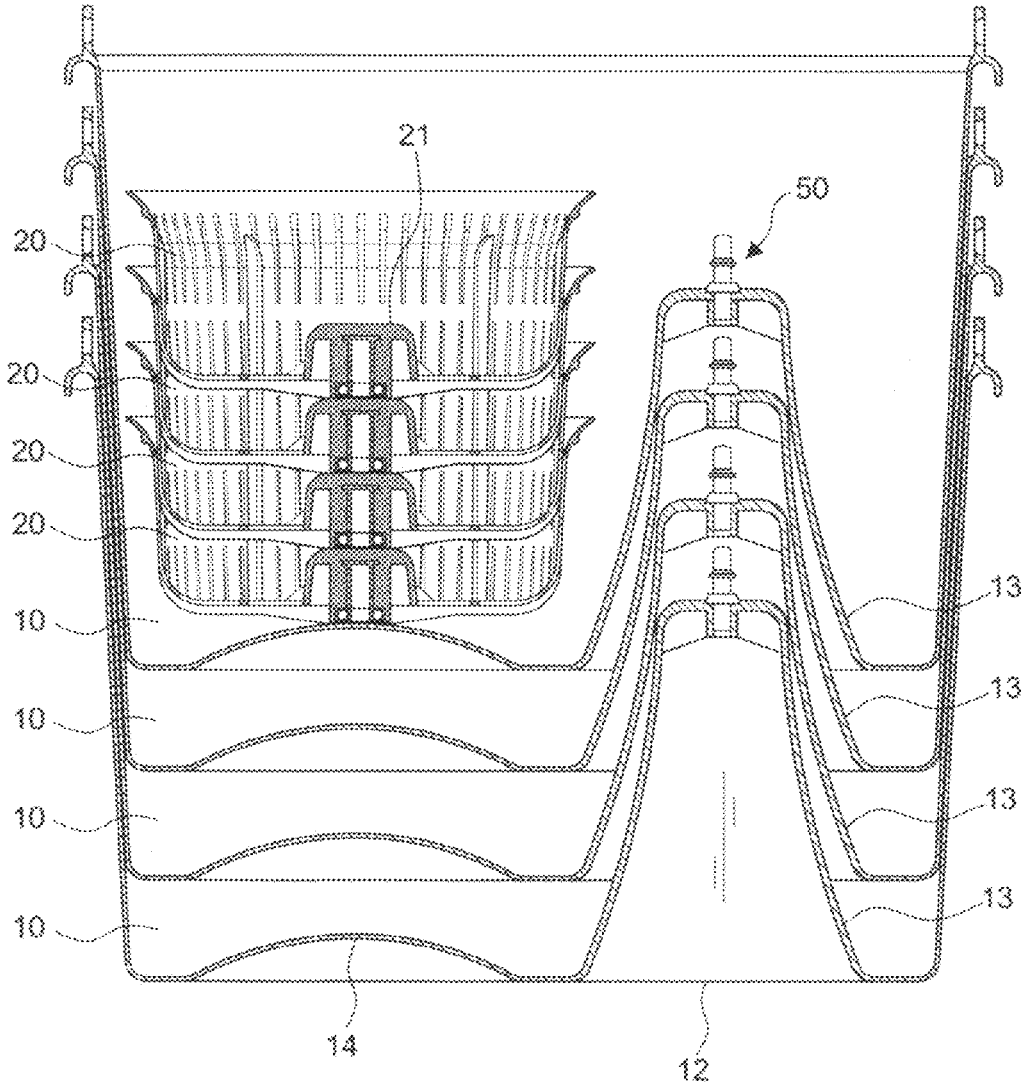
FIG. 10 is a schematic view of stacking a bucket body of the present invention.

The height of the protruding base 13 can be adjusted according to the actual required depth of the bucket body, but the height is preferably greater than or equal to the water level of the water required to be filled into the bucket body. The support shaft 50 can be embedded into the protruding base 13 as shown in FIG. 3, wherein the top surface 131 of the protruding base 13 is a plane. In this preferred embodiment, the protruding base is in a "⎍" shape for storing up as shown in FIG. 10.

With reference to FIGS. 4A, 4B, 4C and 6 for a non-stepping wringer bucket in accordance with the present invention, the under part of the support shaft 51 is covered and fixed on the protruding base 13. The upper part of the support shaft protrudes from the top 131 of the protruding base 13 forming a combining-section 52 which further comprises a ringed trough 521.

An orientate element 40 made from a flexible material, wherein the orientate element in the form of an awl 42, tapering on the top, and having a central hole 43 corresponding to the ringed trough 521. Thus the ringed trough 521 receives the orientate element 40, thereon with the bottom 41 of the protruding part of the orientate element 40 forming a positioned surface 421. The orientate element may be made from rubber.

The dewatering basket 20 has a plurality of holes disposed at the periphery and bottom surface of the dewatering basket 20, and a rotating element 30 is installed at the bottom of a rotating base 21, the rotating base 21 is sheathed onto the support shaft 50 and is installed at the bottom of the dewatering basket 20. Based on a covered part 212, makes the rotating element 30 position under the bottom of the rotating base 21, but not limited. The rotating element 30 can be a bearing, but not limited.

One of the features of the present invention, it is not necessary to transport the wringer bucket 100 as a whole, and the wringer buckets 100 can be stacked with one another as shown in FIG. 10 for making a shipment from factory, and users can assemble the wringer buckets on their own. While assembling the dewatering basket, the rotating element 30 needs to pass over the combining-section 52, thus the rotating base 21 is sheathed onto the support shaft 50 and bases on the positioned surface 421 which prevents the dewatering basket 20 from shedding. The internal diameter of the rotating element 30 is almost equal to the support shaft 50 but a little smaller than the positioned surface 421. The awl 42 has an incline and is flexible, thus the orientate element 40 sheathes with the rotating element 30 by the incline of the awl 42. Since the awl 42 is flexible, the dewatering basket 20 can be easily assembled on the support shaft 50. The positioned surface 421 also prevents the dewatering basket 20 from shedding while the dewatering basket 20 is rotating.

The rotating base 21 can be a bearing house, which is protruding from the middle of the bottom surface in the dewatering basket 20 in this preferred embodiment. The rotating base 21 has a wear-resisting socket 211 formed on a surface in contact with the support shaft 50 and sheathed onto the support shaft 50, such that when the support shaft 50 is rotated, the wear-resisting socket 211 can prevent the rotating base 21 from being worn out or reducing the using life.

Figure 6:
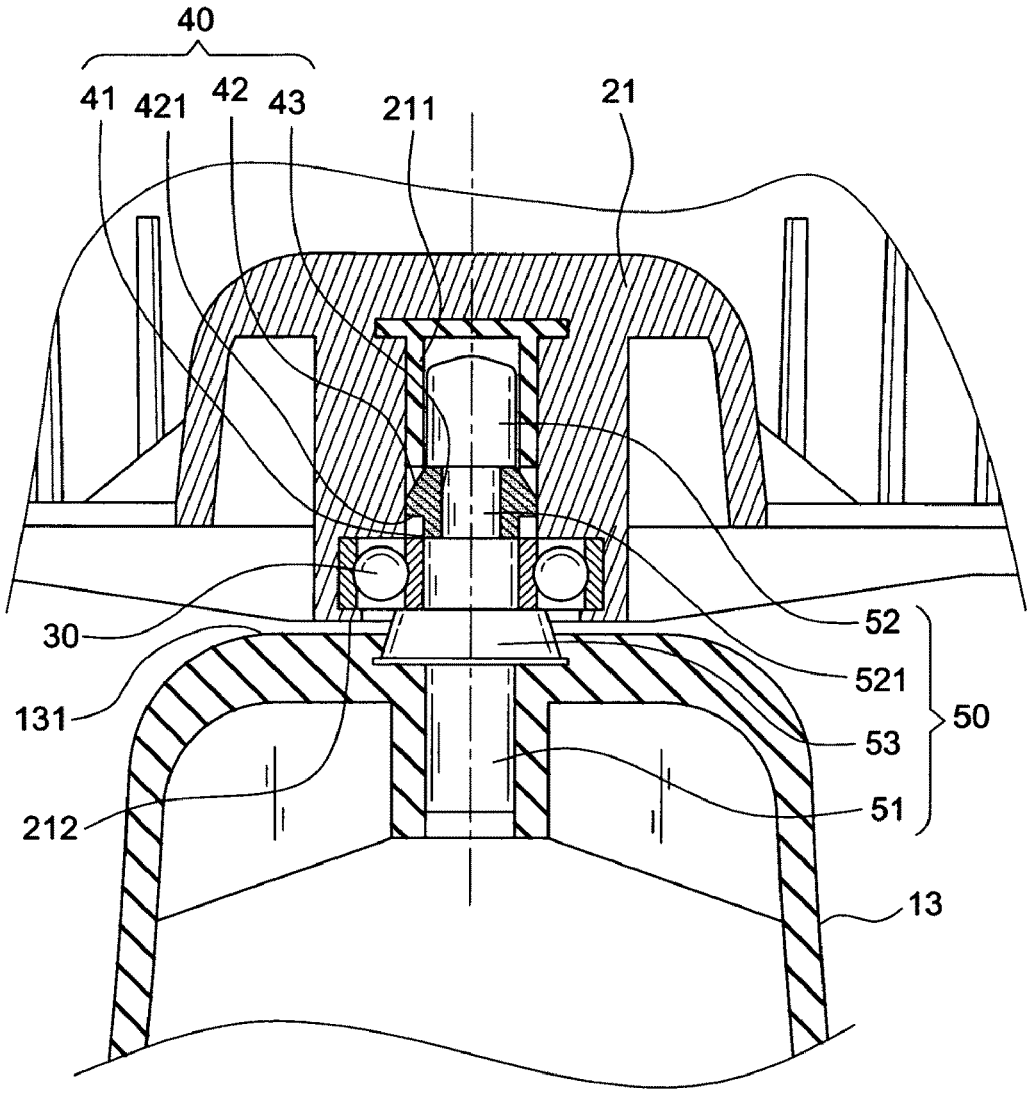
FIG. 6 is an enlarged view of Section 6 of FIG. 5.

With reference to FIG. 6, the support shaft 50 further comprises a ringed-protrusion 53 in a form of an awl. The down part of the ringed protrusion 53 is enclosed with the protruding base 13 and the upper part of the ringed protrusion 53 is protruded from the top 131 of the protruding base 13 for the rotating element 30 to lean against. The ringed-protrusion 53 also prevents the support shaft 50 shedding from the protruding base 13.

Figure 7:
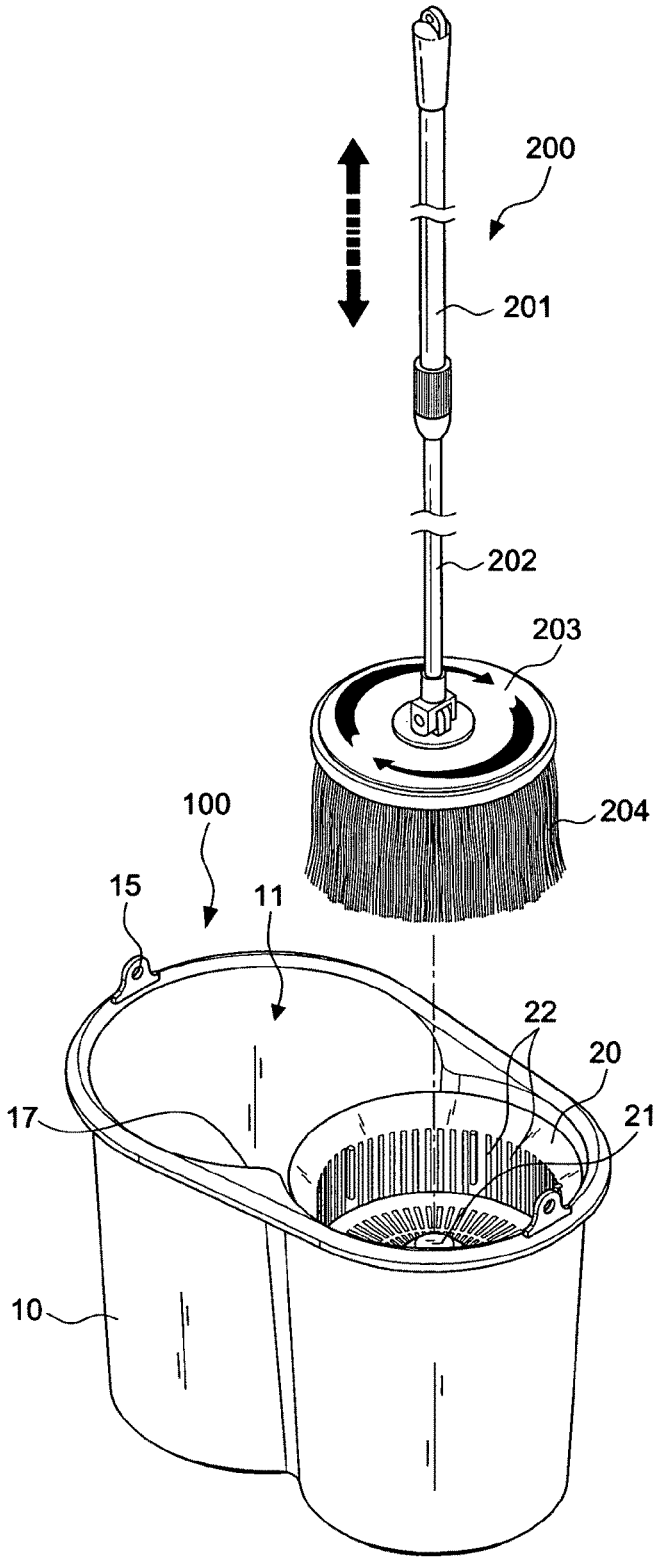
FIG. 7 is a schematic perspective view of a mop and the present invention.
Figure 8:
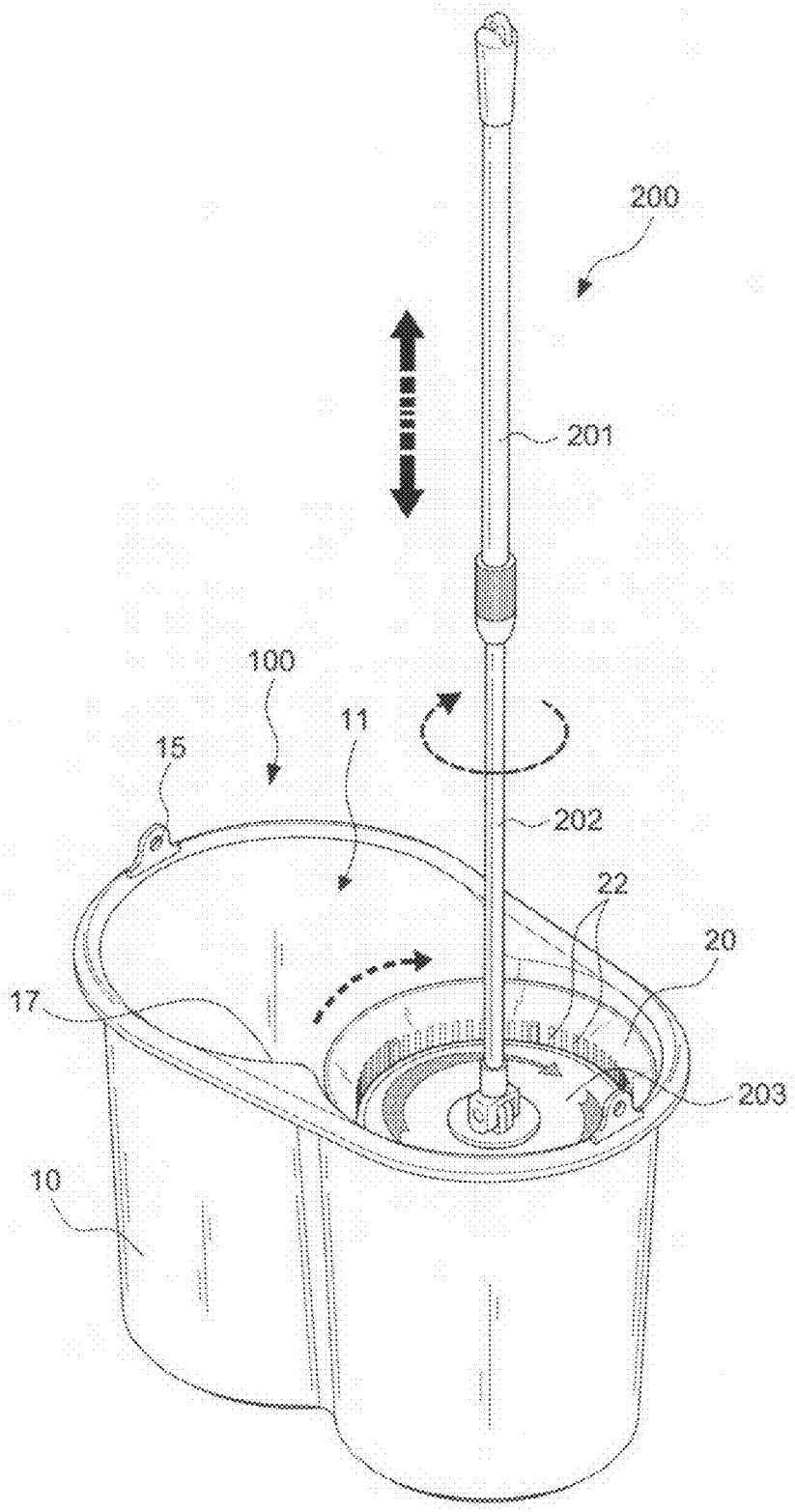
FIG. 8 is a schematic perspective view of combining a mop with the present invention.

With reference to FIGS. 7 and 8 for schematic views of the present invention provided for its use with a mop 200, the mop 200 comprises an external rod 201, a internal rod 202, a mop head 203 and mop yarns 204 installed at the bottom of the internal rod 202, such that if a user wants to dry the water in the mop yarns 204, then the user will put the mop head 203 and mop yarns 204 into the dewatering basket 20, and manually operate the external rod 201 to rotate the internal rod 202, so as to drive the mop head 203 and the mop yarns 204 to link the dewatering basket 20 which is in a free moving state. Since the rotating element 30 is installed at the bottom, the rotation will be very smooth to remove water from the mop yarns 204 through the dewatering holes by the centrifugal force.

With reference to FIG. 8, the opening 11 of the present invention is in an ∞ shape with an inwardly concave arc 17 disposed separately on both sides of the middle of the ∞ shape, such that when the mop 200 is dewatered, water drops in the mop yarns 204 are tossed away in a tangential direction by the centrifugal force, and the traveling direction of the water drops hits the inwardly concave arc 17 at the middle section of the opening 11, and the water drops slides down along internal sidewalls of the bucket body 10. The design of such inwardly concave arc 17 can minimize the sprinkling of water and avoid water from splashing a user or the floor.

Figure 9:
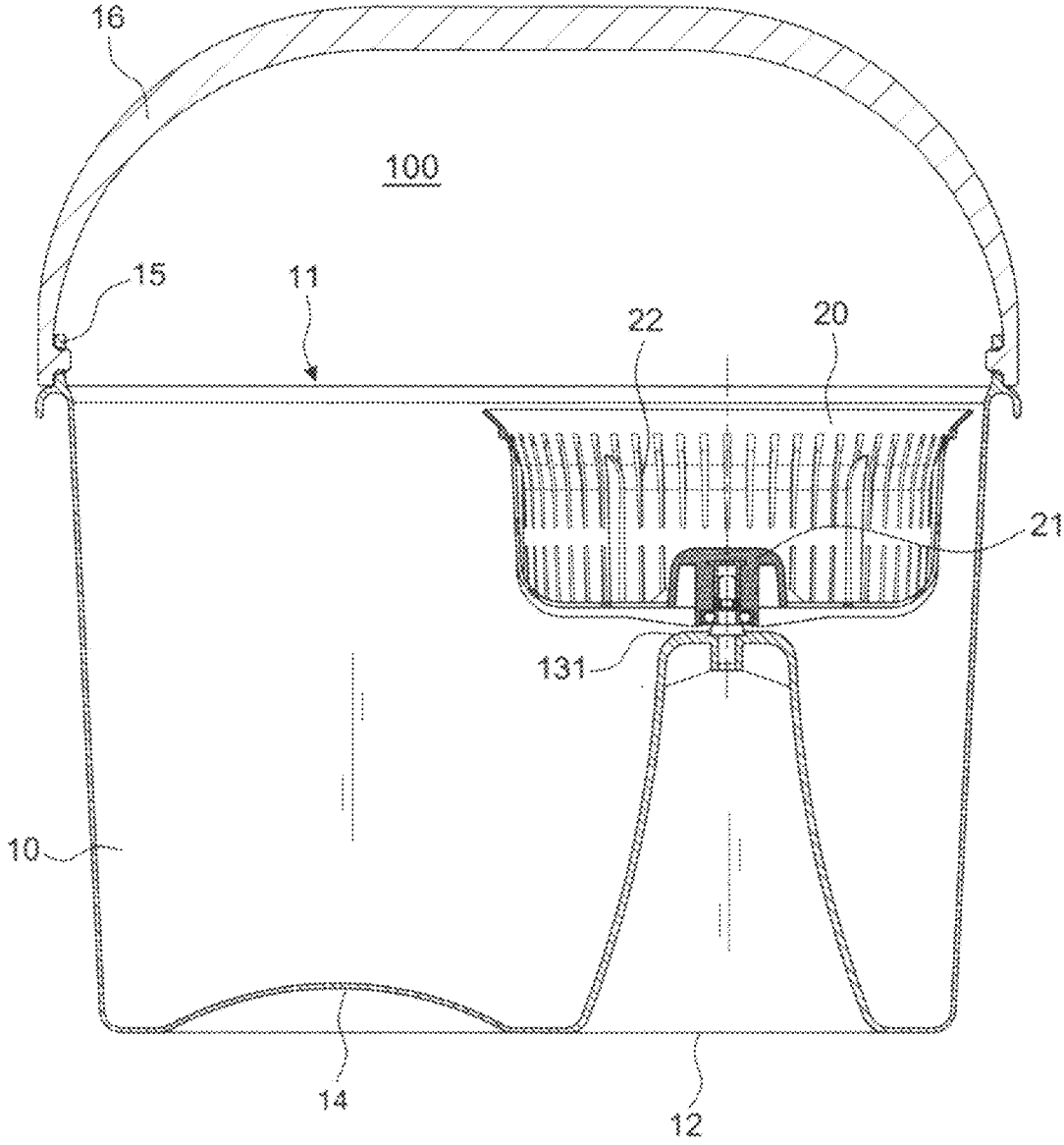
FIG. 9 is a schematic view of the present invention installed with a handle.

The non-stepping wringer bucket 100 of the present invention as shown in FIG. 9 includes a pair of lugs 15 disposed on both sides of the top of the bucket body 10 respectively and connected to a handle 16 for facilitating users to carry the wringer bucket 100. The bottom 12 of the bucket body 10 further includes a convex cambered surface 14 protruded from the bottom 12 for enhancing the support force of the bucket body 10, such that when the rotating element 30 is rotated, the non-stepping wringer bucket 100 will not be shaken.

With the design of the non-stepping wringer bucket in accordance with the present invention, users no longer need to squeeze the mop by a foot-stepping method. As for elderly users, such design can improve the safety of using the wringer bucket.

With the design of the non-stepping wringer bucket in accordance with the present invention, the down part 51 of the support shaft 50 is enclosed and fixed into the protruding base 13. Since the support shaft 50 is fixed and not for rotating, the water in the non-stepping wringer bucket would not seep through the support shaft 50.

In the non-stepping wringer bucket of the present invention, the rotating element 30 allows the dewatering basket 20 to rotate freely, and whose structure design is simple, so that the wringer bucket will not be worn out easily for a long time of use. Such arrangement gives a lower price for users and reduces the production cost for manufacturers effectively. Therefore, the present invention can create a win-win situation for both of the users and manufacturers.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A non-stepping wringer bucket, comprising:

a) a bucket body, having a top surface substantially in a form of an opening, and a bottom surface having a protruding base;

b) a support shaft having an under part and an upper part, the under part of the support shaft covered and fixed on the protruding base, the upper part of the support shaft protruding from the top of the protruding base, forming a combining-section having a ringed trough;

c) an orientate element made from flexible material, wherein the orientate element in the form of an awl, tapering on the top, and having a central hole corresponding to the ringed trough, the ringed trough receives the orientate element thereon, with a bottom of the protruding part of a orientate element forming a positioned surface; and d) a dewatering basket, having a plurality of holes disposed at the periphery and bottom surface of the dewatering basket, and a rotating element installed at the bottom of a rotating base, the rotating base sheathed onto the support shaft and installed at the bottom of the dewatering basket, when assembling the dewatering basket the rotating element passes over the combining-section thus the rotating base is sheathed onto the support shaft and bases on the positioned surface which prevents the dewatering basket from shedding.

2. The non-stepping wringer bucket of claim 1, wherein the support shaft further comprising a ringed-protrusion in a form of an awl, the ringed-protrusion having a down part and an upper part, the down part of the ringed protrusion enclosed with the protruding base and the upper part of the ringed protrusion protruding from the top of the protruding base for the rotating element to lean against.

3. The non-stepping wringer bucket of claim 1, wherein the orientate element is made from rubber.

4. The non-stepping wringer bucket of claim 1, wherein the rotating base is protruded from the center of the bottom surface inside the dewatering basket, and includes a wear-resisting socket sheathed therein.

5. The non-stepping wringer bucket of claim 1, wherein the rotating element is a bearing.

6. The non-stepping wringer bucket of claim 1, wherein the bucket body includes an opening which is in an "∞" shape with an inwardly concave arc disposed separately on both sides of the middle of the "∞" shape.

7. The non-stepping wringer bucket of claim 1, wherein the bucket body includes a convex cambered surface protruded from the bottom of the bucket body for enhancing a support force of the bucket body.

8. The non-stepping wringer bucket of claim 1, wherein the bucket body includes a pair of lugs disposed on both sides of the top of the bucket body respectively for connecting a handle.

9. The non-stepping wringer bucket of claim 1, wherein the bottom of the protruding base is in a "⎍" shape for storing up.

* * * * *